US005863870A

United States Patent [19]

Rao et al.

[11] Patent Number: 5,863,870

[45] Date of Patent: Jan. 26, 1999

[54] LOW ENERGY LEVEL POWDER FOR PLASMA DEPOSITION HAVING SOLID LUBRICANT PROPERTIES

[75] Inventors: V. Durga Nageswar Rao, Bloomfield Township; Robert Alan Rose, Grosse Pointe Park; David Alan Yeager, Plymouth; Carlo Alberto Fucinari, Farmington Hills, all of Mich.

[73] Assignee: Ford Global Technologies, Inc., Dearborn, Mich.

[21] Appl. No.: 799,738

[22] Filed: Aug. 18, 1997

Related U.S. Application Data

[62] Division of Ser. No. 352,666, Dec. 9, 1994, Pat. No. 5,663,124.

[51] Int. Cl.[6] ..... C10M 103/04; B22F 1/00

[52] U.S. Cl. ..... 508/150; 75/246; 75/255

[58] Field of Search ..... 508/150; 75/246, 75/255

[56] References Cited

U.S. PATENT DOCUMENTS

| | | | |
|---|---|---|---|
| 5,145,513 | 9/1992 | Matteazzi et al. | 75/255 |
| 5,385,789 | 1/1995 | Rangaswamy et al. | 75/255 |
| 5,663,124 | 9/1997 | Rao et al. | 508/150 |

OTHER PUBLICATIONS

Chemical Abstracts :82:128338.

*Primary Examiner*—Jacqueline V. Howard
*Attorney, Agent, or Firm*—Joseph W. Malleck

[57] ABSTRACT

An iron or copper based metal powder useful for plasma deposition of a coating that has a dry coefficient of friction 0.75 or less and readily conducts heat through the coating. The powder comprises (a) $H_2O$ atomized and annealed particles consisting essentially of (by weight) carbon 0.15–0.85%, oxygen 0.1–0.45%, an air hardening agent selected from manganese and nickel of 0.1–06.5%, and the remainder iron or copper, with at least 90% of the particles having oxygen and iron or copper combined in the lowest atomic oxygen form for an oxide of such metal.

A method of making anti-friction iron powder that is economical, selectively produces FeO and promotes fine flowable particles. The method comprises (a) steam atomization of a molten steel that excludes other oxygen, the steel containing carbon up to 0.4% by weight to produce a collection of comminuted particles, and (b) annealing the particles in an air atmosphere for a period of time of 0.25–2.0 hours in a temperature range of 800°–1400° F. to reduce carbon in the particles to about 0.2% or sponge iron by reducing $Fe_3O_4$ or $Fe_2O_3$ in CO and ($H_2O$ steam) to attain nearly all iron with nearly all FeO and 0.1° to 0.85° C.

2 Claims, 3 Drawing Sheets

LOW ENERGY LEVEL POWDER FOR PLASMA DEPOSITION HAVING SOLID LUBRICANT PROPERTIES

This is a divisional of application Ser. No. 08/352,666 filed Dec. 9, 1994, now U.S. Pat. No. 5,663,124.

BACKGROUND OF THE INVENTION

1. Technical Field

This invention relates to a controlled steel composition useful as a powder that is plasma sprayable and functions as a heat transferring solid lubricant when deposited as a thin coating on surfaces exposed to high temperatures.

2. Discussion of the Prior Art

Automotive engines present a wide variety of interengaging components that generate friction as a result of interengagement. For example, sliding contact between pistons or piston rings with the cylinder bore walls of an internal combustion engine, account for a significant portion of total engine friction. It is desirable to significantly reduce such friction, by use of durable anti-friction coatings, particularly on the cylinder bore walls, to thereby improve engine efficiency and fuel economy, while allowing heat to be transmitted across such coatings to facilitate the operation of the engine cooling system.

Nickel plating on pistons and cylinder bore walls has been used for some time to provide corrosion resistance to iron substrates while offering only limited reduction of friction because of the softness and inadequate formation of nickel oxide (see U.S. Pat. No. 991,404). Chromium or chromium oxide coatings have been selectively used in the 1980's to enhance wear resistance of engine surfaces, but such coatings are difficult to apply, are unstable, very costly, and fail to significantly reduce friction because of their lack of holding an oil film, have high hardness, and often are incompatible with piston ring materials. In the same time period, iron and molybdenum powders also have been jointly applied to aluminum cylinder bore walls in very thin films to promote abrasion resistance. Such system offers only a limited advantage. Molybdenum particles and the many oxide forms of iron that result from the conventional application processes, do not possess a low coefficient of friction that will allow for appreciable gains in engine efficiency and fuel economy.

SUMMARY OF THE INVENTION

In a first aspect, it is an object of this invention to provide an iron-based low cost metal powder useful for plasma deposition of a coating that (i) will possess an ultra-low dry coefficient of friction (i.e. about 0.2) and (ii) will readily conduct heat through the coating. To this end, the invention is an iron or copper based powder composition for thermal spraying, composing $H_2O$ atomized Fe or copper based particles having at least 90% of the Fe or copper metal, that is combined with oxygen, is combined in the lowest atomic oxygen form for an oxide of such metal o. The invention is also more particularly a low alloy steel powder composition comprising (a) $H_2O$ atomized and annealed iron alloy particles consisting essentially of (by weight) carbon 0.15–0.85% , oxygen 0.1–0.45%, an air hardening agent selected from manganese and nickel of 0.1–6.5%, and the remainder iron, with at least 90% of the particles in Fe or iron alloy form and nearly all the oxygen combined in the FeO form.

In a second aspect, it is an object of this invention to provide a method of making anti-friction iron powder that (i) is highly economical, (ii) selectively produces FeO and (iii) promotes fine flowable particles. To this end, the invention is a method of making low alloy steel powder suitable for plasma deposition, comprising the steps of (a) $H_2O$ (steam) atomization of a molten stream of steel containing carbon up to 0.9% by weight to produce a collection of comminuted particles; the steam atomization is carried out to exclude the presence of other oxygen, restricting reaction of iron to the oxygen in the waterbased steam thereby encouraging the creation of FeO, and (b) annealing the particles in an air atmosphere for a period of time of 0.25–10.0 hours in a temperature range of 800°–1600° F. to reduce carbon in the particles to about 0.15% to 0.45% Another form of the powder is produced as sponge through the reduction of magnetite or hematite ($Fe_3O_4$ or $Fe_2O_3$) with $H_2O$ and CO to reduce to Fe and FeO. It is extremely important that the final composition be completely free from $Fe_3O_4$ and $Fe_2O_3$ and the amount of carbon present be in the range of about 0.15% to 0.4%.

DETAILED DESCRIPTION AND BEST MODE

Figure 1:
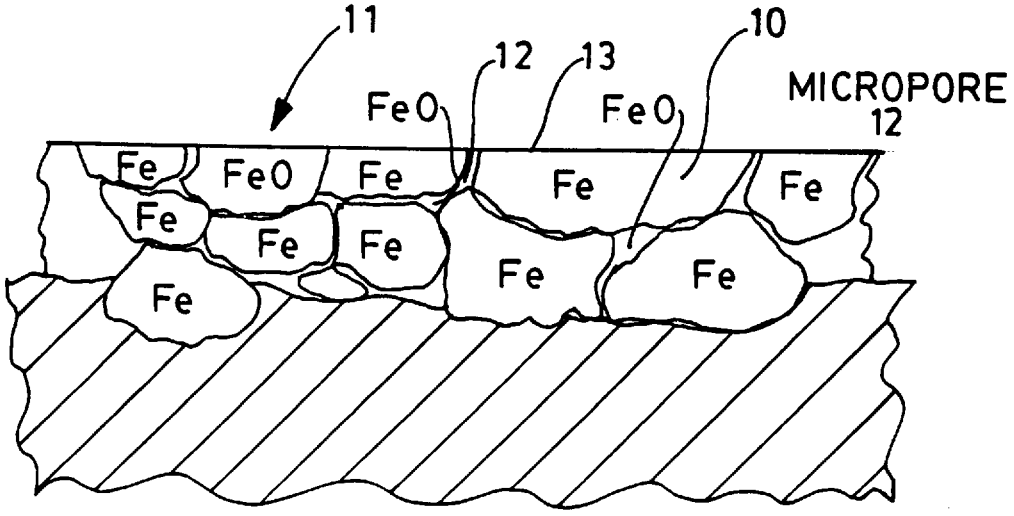
FIG. 1 is an enlarged schematic cross sectional illustration of iron based particles fused in a plasma deposited coating.

The unique powder of this invention, depositable by plasma spraying, exhibits a low coefficient of dry friction in the deposited form, and readily permits thermal transfer of heat through the coating. As shown in FIG. 1, each powder particle 10 consists essentially of a steel grain having a composition consisting essentially of, by weight of the material, carbon 0.15–0.85%, an air hardening agent selected from manganese and nickel in an amount of 0.1–6.5%, oxygen in an amount of 0.1–0.45%, and the remainder essentially iron. Each grain has a controlled size and fused shape which is flattened as a result of impact upon deposition leaving desirable micropores 12. The honed surface 13 of the coating 11 of such particles 10 exposes such micropores. The critical aspect of the steel grains is that at least 90% by weight of the iron, that is combined with oxygen, is combined in the FeO form only. The steel particles have a hardness of about Rc 20 to 40, a particle size of about 10 to 110 microns and a shape generally of irregular granular configuration. The combination of size and shape provide high flowability during plasma spraying, that is essential for smooth flow and a uniform deposition rate and high deposition efficiently.

Figure 2:
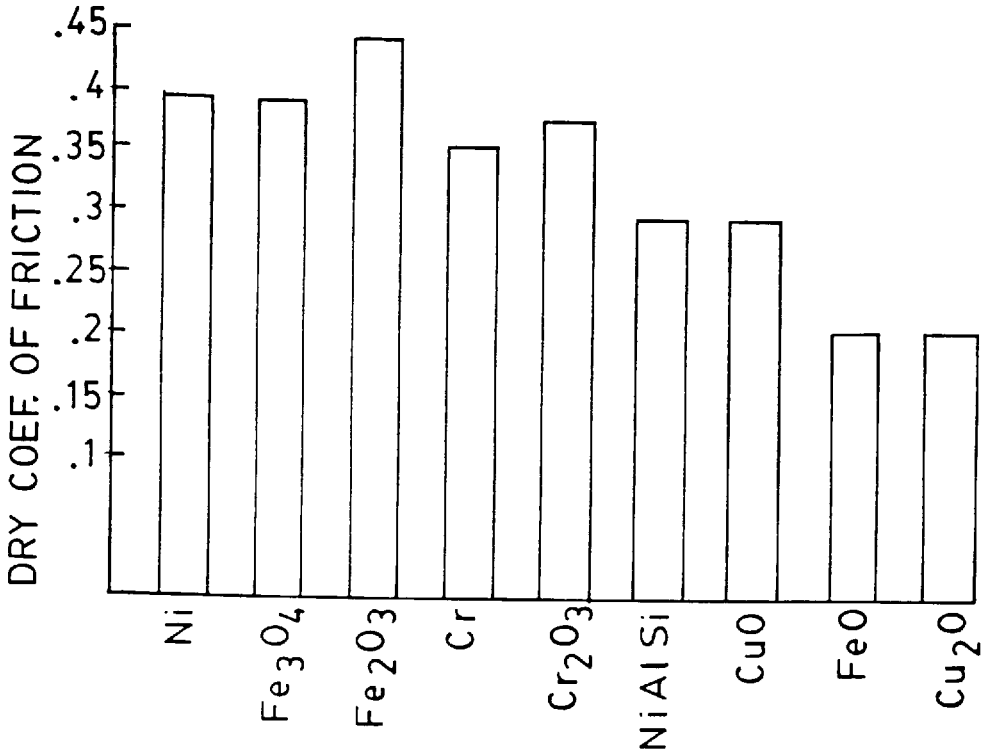
FIG. 2 is a graphical illustration comparing friction data of the powder of this invention with other powders.
Figure 3:
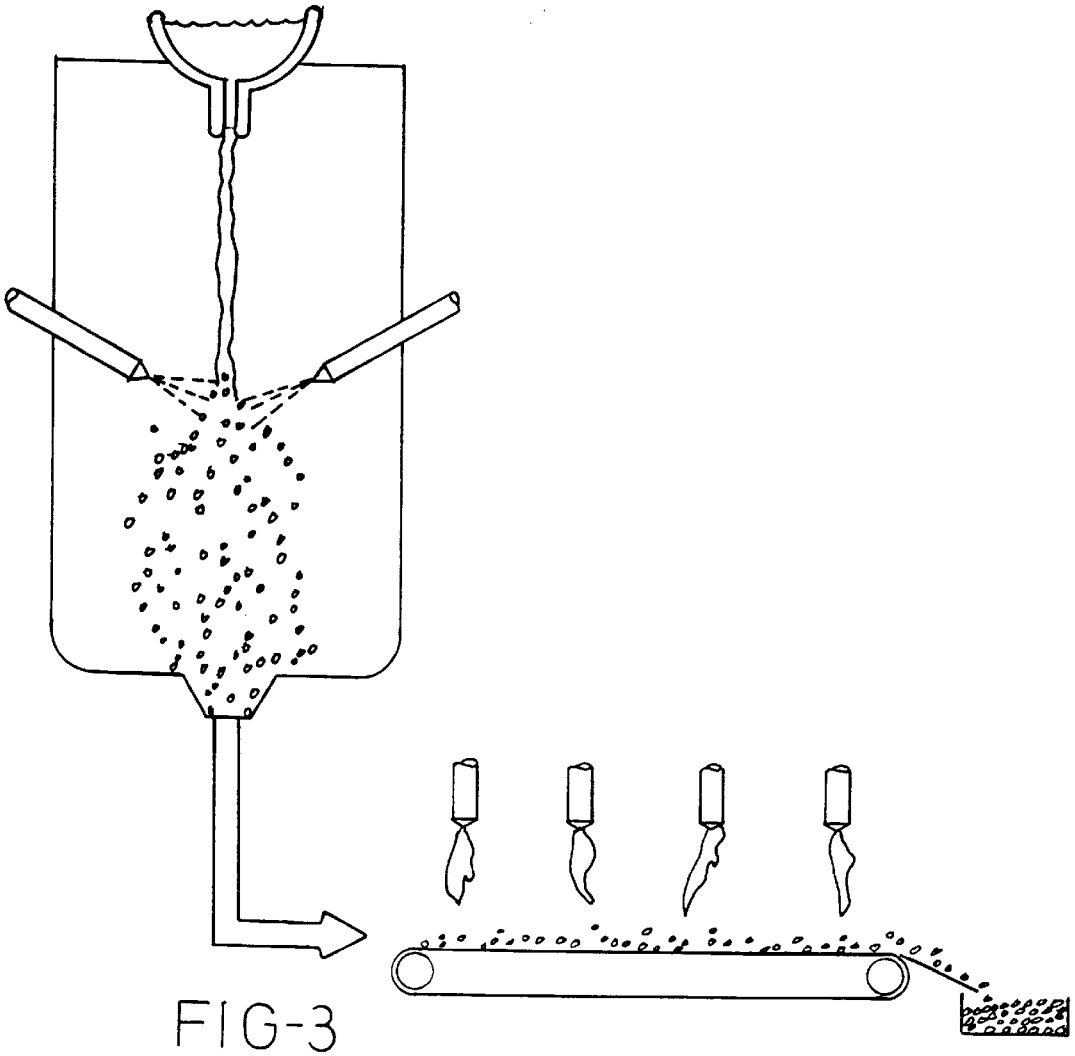
FIG. 3 is a schematic illustration of the method steps of this invention including steam atomization of iron and subsequent annealing.

As comparatively shown in FIG. 2, the coefficient of friction for the FeO form of iron oxide is about 0.2. This compares to a dry coefficient of friction of 0.4 for $Fe_3O_4$ of about 0.45 to 0.6 for $Fe_2O_3$, 0.3 for nickel, 0.6 of NiAlSi, 0.3–0.4 for $Cr_2O_3$, and 0.3–0.4 for chromium.

To produce such steel powder, a molten stream 15 of sponge iron to which has been added some manganese or nickel and carbon (composition essentially consisting of up to 0.9% carbon, 0.1–4.5% manganese or nickel, and the remainder iron except for impurities of about 0.3–0.6%) is introduced to a closed chamber 16 having an inert atmosphere 17 therein. A jet 18 of steam (or water) is impacted at an included angle of less than 90° to the molten stream to chill and comminute the stream 15 into atomized particles 19. Due to the exclusion of air or other oxygen contaminates, the only source of oxygen to unite with the iron in the molten stream is in the steam or water jet itself which is reduced. This limited access to oxygen forces the iron to combine as Fe and not as $Fe_2O_3$ or $Fe_3O_4$ because of the favorable temperature and the presence of carbon, which reacts with higher oxides to reduce them to FeO. The reduction of water releases $H_2$; the hydrogen adds to the nonoxidizing atmosphere in the atomization chamber. The presence or manganese or nickel allows the powder to be air hardenable when heated back up to a temperature of 1200°–1400° F. which will be experienced during plasma spraying. The particles 19 are collected in the bottom 20 of the chamber and thence transferred to a conveyor 20 of an annealing furnace 21 whereupon, for a period of 0.25–2.0 hours, the particles are subjected to a temperature of about 1200°–1400° F. which forces carbon to combine with oxygen in the furnace atmosphere to form CO or $CO_2$ and thereby decarburize the particles to a level of about 0.2% to 0.6% carbon, whichever is desirable.

Figure 4:
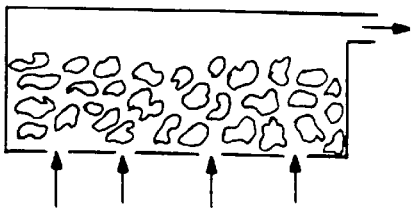
FIG. 4 is a schematic representation of the reduction of magnetite or hematite to sponge iron.
Figure 4A:
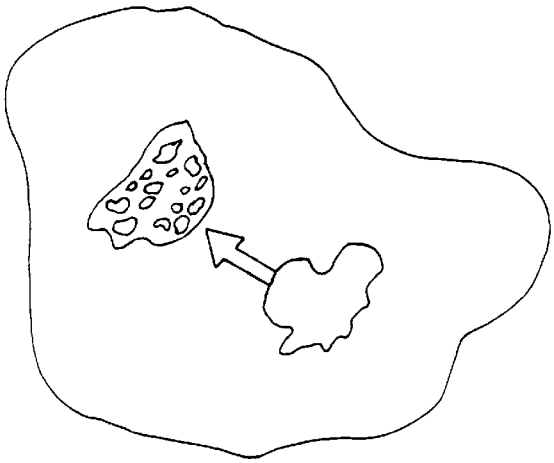
Figure 5:
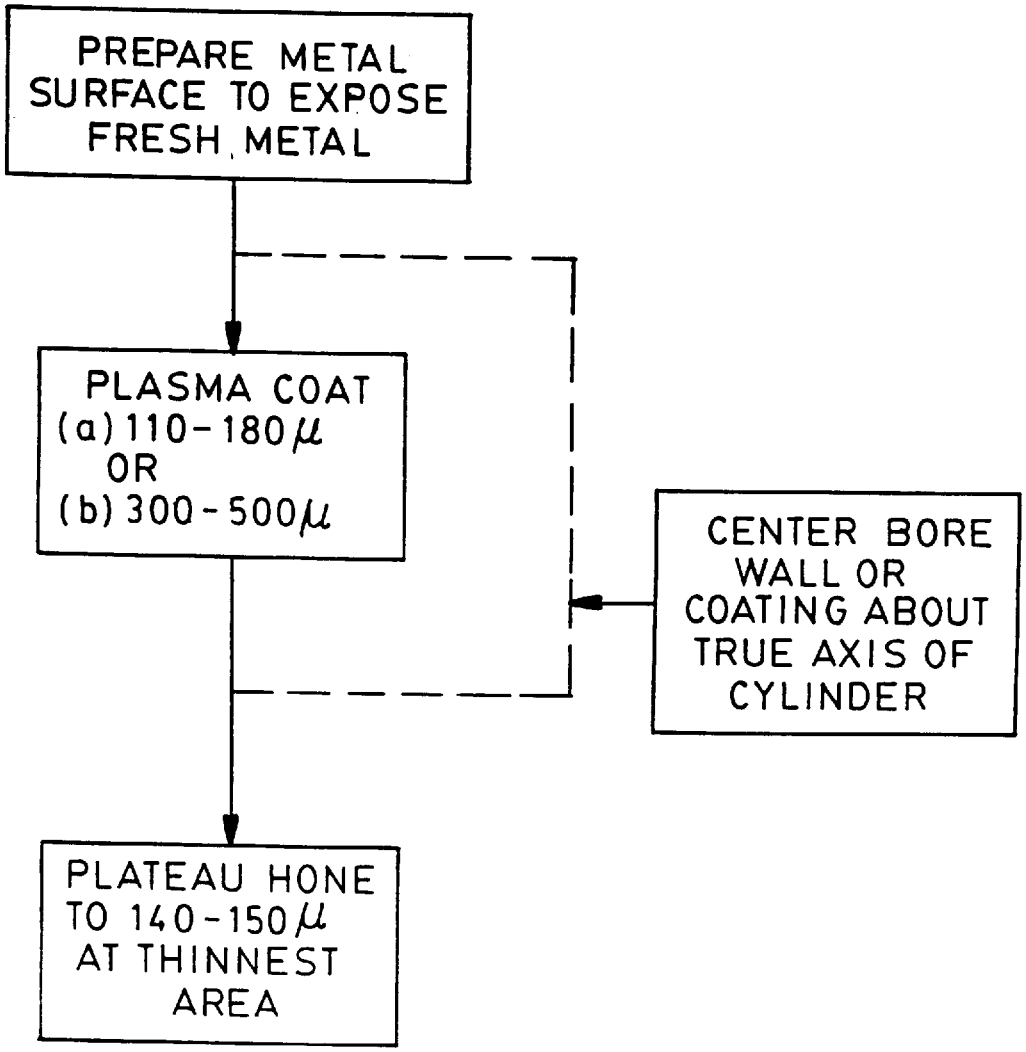
FIG. 5 is a flow diagram of the steps used to fabricate a coated cylinder bore wall using the powder of this invention.

To plasma coat an aluminum cylinder bore wall of an internal combustion engine, with such atomized and annealed particles (see the flow diagram of FIG. 4), the surfaces of the cylinder bore walls are prepared by first washing and degreasing; degreasing can be carried out by hot vapor and the washed walls can be dried by use of oil-free jets of air. Secondly, the clean surfaces are then operated upon to expose fresh metal devoid of aluminum oxide. This can be accomplished by either machining shallow serrations in the bore wall surfaces, electric discharge erosion of the surfaces, or by grit (shot) blasting or hydroblasting (which is very high water blasting) of such surfaces. An alternate process is thermochemical etching using a reactive halogenated gas such as Freon onto heated surface.

If a thin coating (i.e. 110–180 microns) is to be applied, the cylinder bore wall surfaces are centered with respect to the true cylinder axis by machining as part of the surface preparation prior to plasma spraying. This operation is carried out in the conventional way (the cylinder bore centers are truly spaced/centered with respect to the crankshaft bearing axis. If the coating is to be relatively thick (i.e. 300–500 microns), the bore surfaces need not be centered prior to coating; rather, a rough honing operation is effective to center the coated surface relative to the true cylinder bore axis.

Plasma coating is carried out by the procedures adapting the spray parameters and equipment, disclosed in co-pending U.S. Ser. No. ('94-0503) which disclosure is incorporated herein by reference. Finished honing is carried out in plateaus to remove approximately 150 to 200 micros (taken on a radius of the cylinder bore) to flush the surface to a smoothness of 10–30 micro inches. This honing operation is carried out following a certain specified step of grinding using 80/100 grit, 200/300 grit, 400 grit, followed by 600 grit honing stones. This is important to provide a good oil layer retention. Such honing is preferably carried out with silicon carbide or diamond abrasive grit honing stones which provide material removal without oxidizing the iron substrate or the conventional coolant (i.e. a phosphate or stearate detergent oil/water emulsion).

Variations of less than 10–15 microns in surface asperities and freedom from distortion to a maximum 10 to 50 microns throughout the length of the cylinder bore, are considered part of this treatment.

The powder composition may also be constituted of copper/oxide useful for thermal spraying. Such composition is made by $Co/H_2O$ comminution to reduce molten copper to a composite of copper and copper oxide where at least 90% of the volume of such composite oxide is in the cuprous form ($Cu_2O$).

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. An iron or copper based powder composition for thermal spraying, comprising $H_2O$ atomized Fe or copper based particles having at least 90% of the Fe or copper metal combined with oxygen in the lowest atomic oxygen form for an oxide of such metal.

2. A copper.oxide powder composition for thermal spraying, comprising $CO/H_2O$ reduced copper particles having at least 90% by volume of the particles combined with oxygen in the cuprous ($Cu_2O$) form only.

* * * * *